US005386659A

United States Patent [19]

Vaid et al.

[11] Patent Number: 5,386,659

[45] Date of Patent: Feb. 7, 1995

[54] FIRE CONTROL MECHANISM FOR SEMIAUTOMATIC PISTOLS

[75] Inventors: Pardip K. Vaid, Hatfield; Lee M. Lenkarski, Ware; Kevin G. Foley, Springfield, all of Mass.

[73] Assignee: Smith & Wesson Corp., Springfield, Mass.

[21] Appl. No.: 168,148

[22] Filed: Dec. 17, 1993

[51] Int. Cl.[6] ..... F41A 19/32; F41A 19/38

[52] U.S. Cl. ..... 42/69.02; 89/145

[58] Field of Search ..... 42/69.02, 69.03; 89/144, 145, 27.11

[56] References Cited

U.S. PATENT DOCUMENTS 1,403,133 1/1922 Stokke ..... 89/145
5,157,209 10/1992 Dunn ..... 89/145

FOREIGN PATENT DOCUMENTS 672472 3/1939 Germany ..... 42/69.02
347653 7/1937 Italy ..... 42/69.02

*Primary Examiner*—Stephen M. Johnson
*Attorney, Agent, or Firm*—Chapin, Neal & Dempsey

[57] ABSTRACT

A fire control mechanism for a firing pin striker operated semiautomatic double action handgun includes a sear pivotably disposed on a frame between forward and rearward positions. The sear includes an edge portion for controlling the firing pin and further includes a cam surface for downward displacement of the sear to release the firing pin in response to trigger firing movement. The firing pin includes an extension adapted to be in planar movement with the controlling edge of the sear with selective engagement and disengagement therewith in response to angular and translatory movement of the sear upon response to actuation of the trigger. A trigger bar includes a disconnect portion disposed to move the trigger bar downwardly upon recoil of the slide. The sear, firing pin extension, cam surface and trigger are all movable in coplanar relationship with one another and the trigger bar and disconnect are movable in a plane parallel thereto.

11 Claims, 5 Drawing Sheets

FIG. 9
FIG. 8
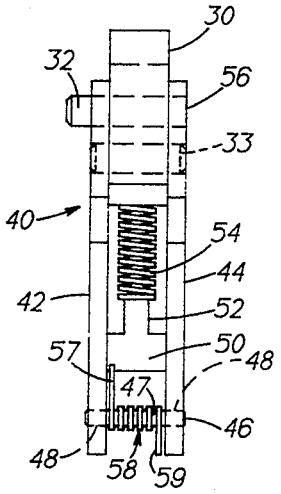
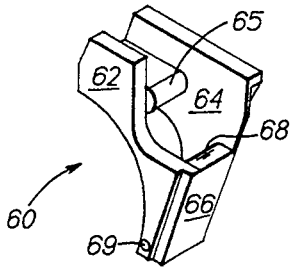
FIG. 10
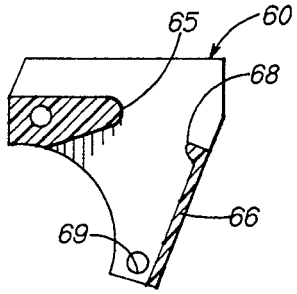
FIG. 11
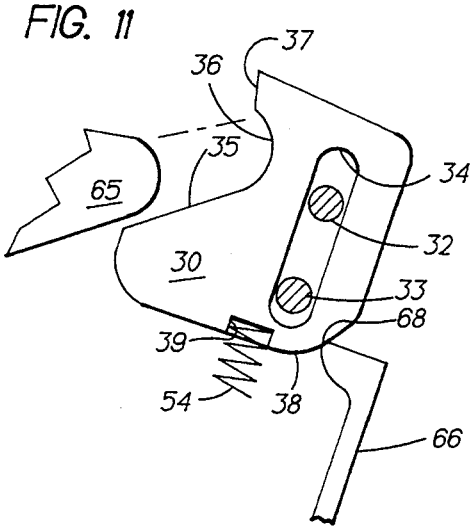
FIG. 12
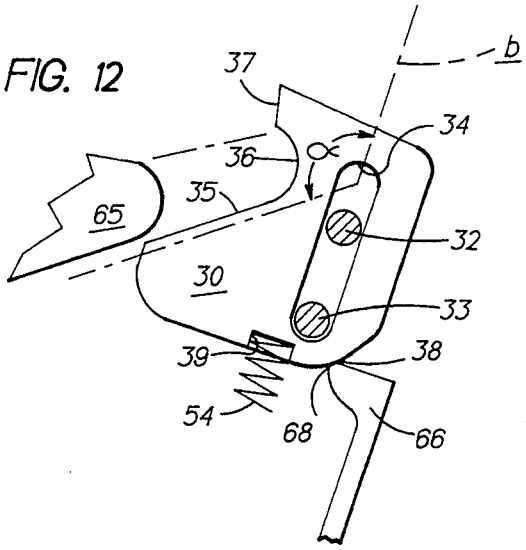

FIRE CONTROL MECHANISM FOR SEMIAUTOMATIC PISTOLS

FIELD OF THE INVENTION

This invention relates to firearms and more particularly to a double-action fire control mechanism for a semiautomatic pistol or handgun which employs a firing pin striker mechanism.

BACKGROUND OF THE INVENTION

One type of fire control mechanism commonly used in semiautomatic hand-guns includes a hammer which is pivotable from a rearward cocked position to a forward position for impacting the firing pin. A sear releasably retains the hammer in its cocked position with the hammer spring or main spring in compression. When the trigger is actuated, the sear is moved to release the hammer that is moved by the stored energy of the main spring, to strike the firing pin which is thereby driven forward to fire a chambered round. The principal drawback of this type of mechanism is that it includes numerous parts and is relatively complex and expensive to manufacture.

Another common configuration is disclosed in U.S. Pat. No. 3,857,325 to Thomas wherein a striker type firing pin is utilized in lieu of a pivotable hammer. Upon actuation of the trigger, a trigger bar operated sear engages a projection that extends from the firing pin and moves the firing pin rearward, thereby to compress a firing pin spring. When the trigger is moved a predetermined distance rearward, the sear will be moved to release the firing pin projection whereby the firing pin spring will drive the firing pin in a forward direction with sufficient force to fire a chambered round. This mechanism has at least one principal disadvantage in that there is no provision for disconnecting the sear from the trigger to allow the sear to move independently back into the path of the firing pin during the recoil of the slide. The absence of this feature makes for a gun having a relatively low rate of fire. In addition, this mechanism may be difficult to manufacture and its components subject to fatigue and failure with extensive usage.

Other configurations which utilize firing pin striker mechanisms include those disclosed in U.S. Pat. Nos. 4,539,889; 4,825,744 and 4,893,546 issued to Glock. In all but one of the configurations of the above referenced patents, which discloses a hammer for engaging the firing pin, an abutment is provided to alternately engage and disengage the nose of a firing pin. When the trigger is actuated, the abutment engages the downwardly depending nose of the firing pin and moves the same rearwardly until the nose and the abutment have reached a predetermined position. With the firing pin at that position, the spring will have been compressed and various control or camming means are disclosed for moving the abutment out of the path of the firing pin nose whereby the firing pin spring will impel the firing pin with sufficient force to fire a chambered round.

One of the principal characteristics of such prior art pistols is that, even before actuation of the trigger, the firing pin spring is quite strongly preloaded or tensioned in an intermediate or semi-cocked position which operates more in the manner of a single action firing mechanism than a classic double action mechanism.

Another characteristic of certain currently available pistols is that the firing mechanism includes a spring to assist in the rearward or firing movement of the trigger in lieu of the more conventional type trigger spring that opposes the trigger pull. That spring aids the trigger pull and thus assists in the compression of the main firing pin spring so that the pistols will have a relatively light trigger pull over a substantial portion of the length of the trigger stroke.

In each of the embodiments disclosed in the above referenced patents, upon recoil of the slide after a round has been fired, a leaf spring is caused to move laterally to enable the abutment portion of the firing mechanism to be moved upwardly, after the firing pin has been released when the gun is fired. In that upward position, as the firing pin is carried forwardly by the slide, the abutment will be disposed to be reengaged by the nose of the firing pin. With reengagement of the two parts, the abutment will be carried forwardly until the leaf spring snaps back laterally to its initial position and the control surface on the leaf spring will be repositioned ready to cam the abutment downwardly in the next firing cycle. After the first round has been fired, the trigger can be restrained by the shooter against moving forwardly to its original starting point at which it was located prior to firing the first round.

Such pistols can therefore be said to have two different trigger stroke lengths, i.e., the first one of approximately the same length as is conventional and subsequent strokes which are substantially shorter than the conventional stroke. In the use of the shorter stroke, there may be a tendency for some shooters, not fully familiar with that trigger feature, to fire the pistol when not really intending to do so. Furthermore, as the firing pin is carried forwardly by slide after the gun has been fired, when the nose reengages the abutment, the firing pin will be partially cocked and such subsequent strokes would be more in the nature of a single action stroke. The effect is a reduction in the momentum of the forwardly moving slide which substantially lessens the kinetic energy available to return the slide fully to its forward position. Guns of this type have been found to have a higher incidence of the slide failing to close fully during the recoil cycle. With this type of firing mechanism, moreover, the repeated flexing of the leaf spring and forceful impacting of the nose on the abutment will have a tendency to cause excessive wear of these components.

It is the principal object of this invention to provide an improved double action semiautomatic handgun having a striker type firing mechanism which overcomes the drawbacks of similar types of handguns heretofore available.

It is also a primary object of this invention to provide a double action firing mechanism of the above type that provides for application to the trigger of constant force and stroke length for each and every round fired.

It is an additional object of this invention to provide a handgun fire control mechanism of simple and compact construction that is lightweight and relatively inexpensive to manufacture while being safe and reliable in operation.

Another object of this invention is to provide a handgun fire control mechanism which utilizes essentially all of the force of the recoil spring to recycle the slide.

Still another object of this invention is to provide a fire control mechanism of the above type in essentially all the energy of the slide is used to reset the firing mechanism.

According to this invention, a double-action striker type firing mechanism for a semiautomatic pistol includes a trigger bar which pivots a sear lever rearwardly from an initial forward position that is biased toward that forward position by a sear spring. Thus, tensioning of the sear spring as well as compressing a firing pin spring is required to cock the striker and upon the sear achieving predetermined angular and translatory motion from its forward position, the sear is adapted to release the firing pin at a point at which sufficient potential energy has been imparted to the firing pin to fire a chambered round. On recoil of the slide, the sear and firing mechanism are adapted to be fully repositioned for the next cycle by movement in parallel planes.

The above and other objects and advantages of this invention will be more readily apparent from a reading of the following description of an exemplary embodiment thereof taken in conjunction with the following drawings.

BRIEF DESCRIPTION OF THE DRAWINGS

FIG. 8 is a front view on an enlarged scale of the sear and pivot arm assembly of FIGS. 1–5;

FIG. 9 is a perspective view on an enlarged scale of the sear housing;

FIG. 10 is an elevational cross-sectional view of the sear housing of FIG. 9;

FIGS. 11 and 12 are enlarged views of the sear and a cooperating portion of the housing shown in different operative positions;

DETAILED DESCRIPTION OF THE PREFERRED EMBODIMENT

Figure 1:
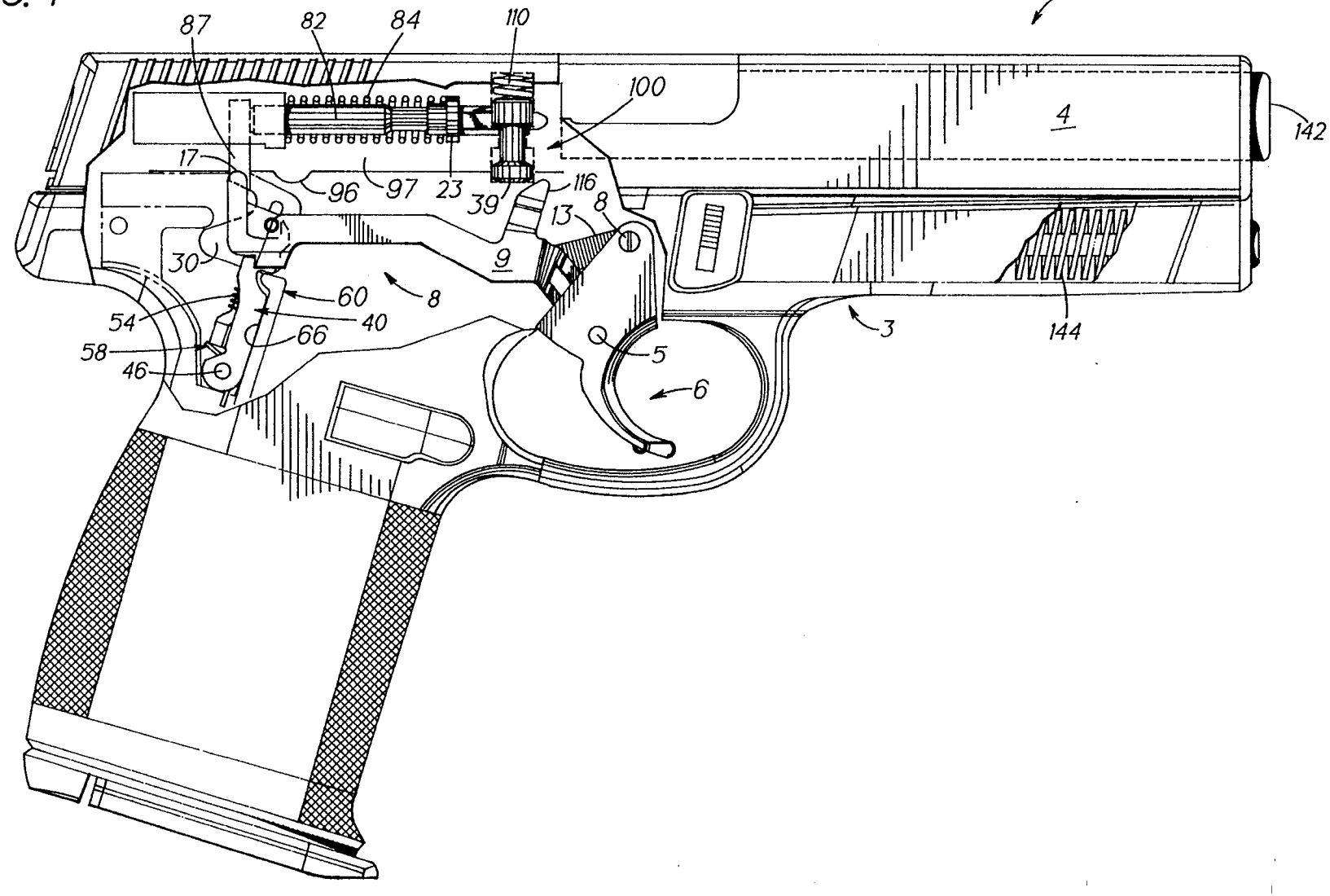
FIG. 1 is an elevational view of a semiautomatic handgun of the type embodying the present invention with portions cut away to expose the firing mechanism.

Referring to FIG. 1, a semiautomatic pistol or handgun 2 is shown and generally comprises a high impact polymeric frame 3, slide 4 and a fire control mechanism 8 embodying the present invention.

The fire control mechanism 8 generally comprises a trigger 6 that pivots to move a trigger bar 9 longitudinally in response to operation of the trigger. The trigger 6 may be of unitary construction, as shown, or of a two-piece articulated construction as disclosed in our copending Application No. 29/019,216, which is hereby incorporated by reference. In either case, when one actuates the trigger, it will move rearward about the pivot pin 7 and its pivotable movement will be transmitted to the trigger bar 9 by a pin 5. Movement of the trigger bar 9 will, in turn, move a sear 30 sufficiently to cause compression and then release the firing pin spring 84 and the gun 2 to be fired, as will hereinafter be described in greater detail. Upon firing, recoil of the gun will cause the trigger bar 9 to be deflected downwardly (FIG. 4) thereby to be disconnected from the sear 30 to enable a sear spring 58 and coil spring 54 to reposition the sear 30 to its forward or "ready" position for the next firing cycle.

Figures 4, 5, 6, 7:
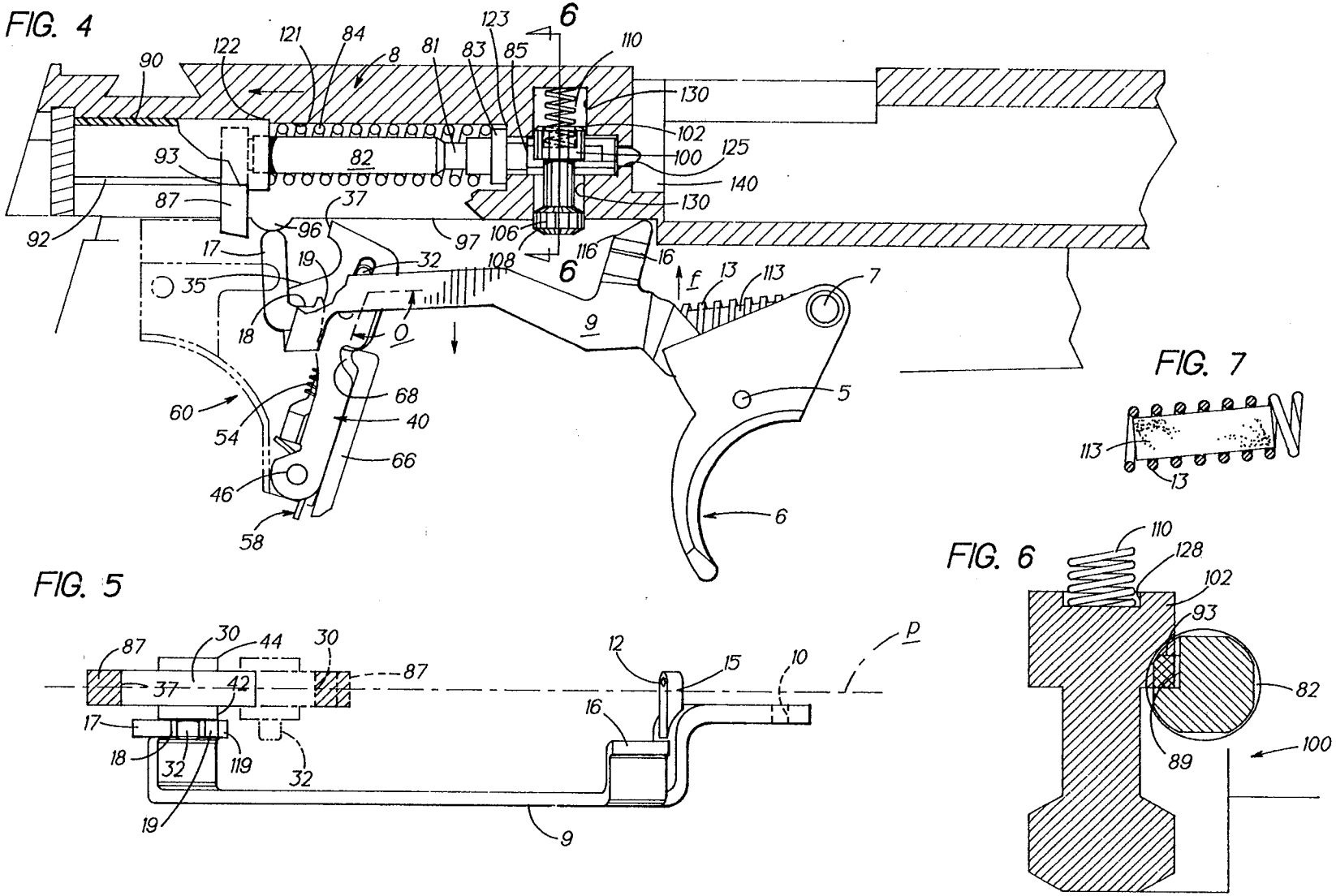
FIG. 4 is an elevational view on an enlarged scale of the firing mechanism of FIG. 3 upon recoil of the slide and recycling of the sear.
FIG. 5 is a top plan view on an enlarged scale of the trigger bar, sear and pivot arm assembly of FIGS. 1–4.
FIG. 6 is a cross-sectional view on an enlarged scale taken along line 6—6 of FIG. 5 which illustrates the area of interengagement between the firing pin and the safety plunger.
FIG. 7 is a cross-sectional view of the firing pin spring in an untensioned condition.

Referring now to FIGS. 1, 4 and 5, the trigger bar 9 is pivotably connected at one end to the trigger 6 by pin 5 fitted into a hole 10 (FIG. 5) adjacent the forward end of the trigger bar 9. Also, adjacent its forward end, the trigger bar includes an upwardly extending finger portion or spur 16 and adjacent its after-end, an upwardly open U-shaped hook 18 defined by an upwardly extending disconnect arm 17 and a lip 19. The hook 18 serves to interengage with sear pin 32 (FIGS. 2 and 8) for moving the sear 30 rearward to cock and then release the firing pin 82 to fire the gun, as will hereinafter be more fully described. The trigger 6 is urged forwardly by an expansion type coil spring 13 that serves as the trigger spring 13 secured at one end to a hole 12 provided through a spring mounting arm 15 which extends transversely of the trigger bar 9 (FIG. 5). The other end of the spring 13 is fitted onto the pivot pin 7 of the trigger. As the trigger is pivoted clockwise about the pivot pin 7, the trigger bar 9 connected to the trigger 6 by pin 5 will move toward the rear of the gun, as illustrated by the arrow a in FIG. 2. This motion will cause spring 13 to be expanded and thus tensioned to urge the trigger bar 9 forwardly for return to its forward position after each round is fired.

As best illustrated in FIG. 7, a shock absorbing medium, such as felt or a cellular foam 113 is preferably disposed within the spring 13 to dampen the oscillations thereof during the operation of the firing mechanism. The medium 113 is preferably in the form of a cylindrical rod that fits closely within the coils of the spring 13 when in its untensioned condition. This medium serves to dampen the oscillation of coil spring 13 during its expansion and contraction to provide for smooth and quiet operation of the firing mechanism embodying this invention.

As shown in FIGS. 1–4, the sear mechanism comprises a sear 30 which is preferably of generally rectangular overall plate-like configuration. The sear is carried by a pivot or swing arm 40 adapted to pivot about a pin 46. A compression coil spring 54 biases the sear 30 upwardly and a torsion or sear spring 58, having a central loop portion, is disposed about a pin 46 and includes a pair of radially extending outer end portions or legs 57 and 59 (FIG. 8). One of the legs 57 engages a cross-bar 50 of the pivot arm and the other leg 59, engages a front wall 66 of a sear housing 60. The sear spring 58 urges the pivot arm 40, to its forward position, as shown in FIG. 1 and opposes the direction of the trigger pull when firing the gun. The pivot arm 40 comprises side walls 42 and 44 (FIG. 8) disposed and secured in spaced parallel relation by transverse pin 33 and lower transverse wall or cross-bar member 50. The forward movement of the pivot arm 40 is limited by forward edges of side walls 42 and 44 of the pivot arm 40 contacting the inner surface of the front wall 66 of the sear housing 60. The sear 30 is preferably fabricated of steel coated with an electroless coating of a nickel phosphorous alloy with Teflon® particles uniformly dispersed therein whereby the surfaces of the sear will be characterized by its long wearing properties and a low coefficient of friction of 0.10 and inherent lubricity. The sear further comprises, at its lower rear edge portion a cam surface 35 disposed at oblique angle $\alpha$ of approximately 135 degrees with reference to the longitudinal axis b of slot 34. At its upper rear edge, the sear 30 is configured to provide a control edge 37 for engagement with the forward lower surface portion of depending leg 87 of the firing pin.

The pivot or swing arm 40 (FIG. 8) has a post stub 52 which extends upwardly from the cross-member 50 and serves to retain the lower end of coil spring 54, the upper end of which is fitted into a socket 39 (FIG. 12) formed in the undersurface of the sear 30. The spring 54 serves to bias the sear 30 radially outward of the pivot pin 46 or generally in an upward direction. The coil spring 54 is compressible and expansible in conjunction with the operation of the firing mechanism in response to the movement of the trigger bar and controls the vertical position of the sear 30.

The extent of vertical movement of the sear 30 is defined by a cutout or slot 34 in the sear plate 30 having its longer or longitudinal axis b generally parallel to the forward edge 31 of the sear 30, as best shown in FIG. 12. Sear pin 32 is secured at one end wall 44 and extends through the elongated slot 34 adjacent the upper end thereof and its other end extends through a hole in wall 42. The pin 32 includes a terminal end portion that protrudes outwardly of the plane of side wall 42, as best shown in FIG. 8 and is a substantial distance above the pivot pin 46. A second transverse pin 33 is disposed in vertically spaced relation below the pin 32 and is also secured to side walls 42 and 44 of the pivot arm 40. The two pins 32 and 33, disposed as they are in vertically spaced parallel relation in slot 34, serve to guide and limit the movement of the sear 30 longitudinally within the pivot arm 40. The pivot arm 40 is fitted within stationary sear housing 60 and secured thereto by the pivot pin 46 which is fitted into holes 69 in the lower end portions of side walls 62 and 64 of the housing 60. The pin 46 extends from the sear housing 60 through bores 48 (FIG. 8) in side walls 42 and 44 of the pivot arm 40. The sear housing 60 is fitted into the frame 3.

As best shown in FIGS. 9 and 10, the sear housing 60 is a molded unitary component of a lightweight, high impact polymer, such as Nylon 66 impregnated with 30% by weight glass fibers and 13% by weight Teflon® particles uniformly dispersed throughout the polymer with the result being that the sear housing 60 will have a low coefficient of friction and inherent lubricity characteristics. The housing is fitted into the frame 3 adjacent its rear end wall and comprises side walls 62 and 64, front wall 66 and a forwardly extending rear wall which at its inner end is configured to provide a convexly curved or radiused arcuate cam engaging member 65 adapted to be engaged by the cam surface 35 of the sear 30 to move the sear downwardly. The front wall 66 of the sear housing 60 is provided at its upper inner edge with a convexly curved or radiused surface which serves as a cam engaging member 68. The member 68 is adapted to engage in line contact with an oppositely radiused or convexly curved cam surface 38 provided on the lower front edge portion of the sear plate 30. These two radiused surfaces serve to return the sear 30 to its upper position in the event of a failure or breakage of the coil spring 54 in which case the firing mechanism would continue to be operative despite such spring failure. In such event, as the sear 30 is pivoted forwardly by the sear spring 58, the cam surface 38 will engage cam member 68, shown in FIG. 11, to move the sear 30 to its upper position, as shown in FIG. 12, for reengagement by control edge 37 of the sear 30 with the forward lower edge portion of leg 87 depending from the firing pin 82, as illustrated in FIG. 1.

Figure 3:
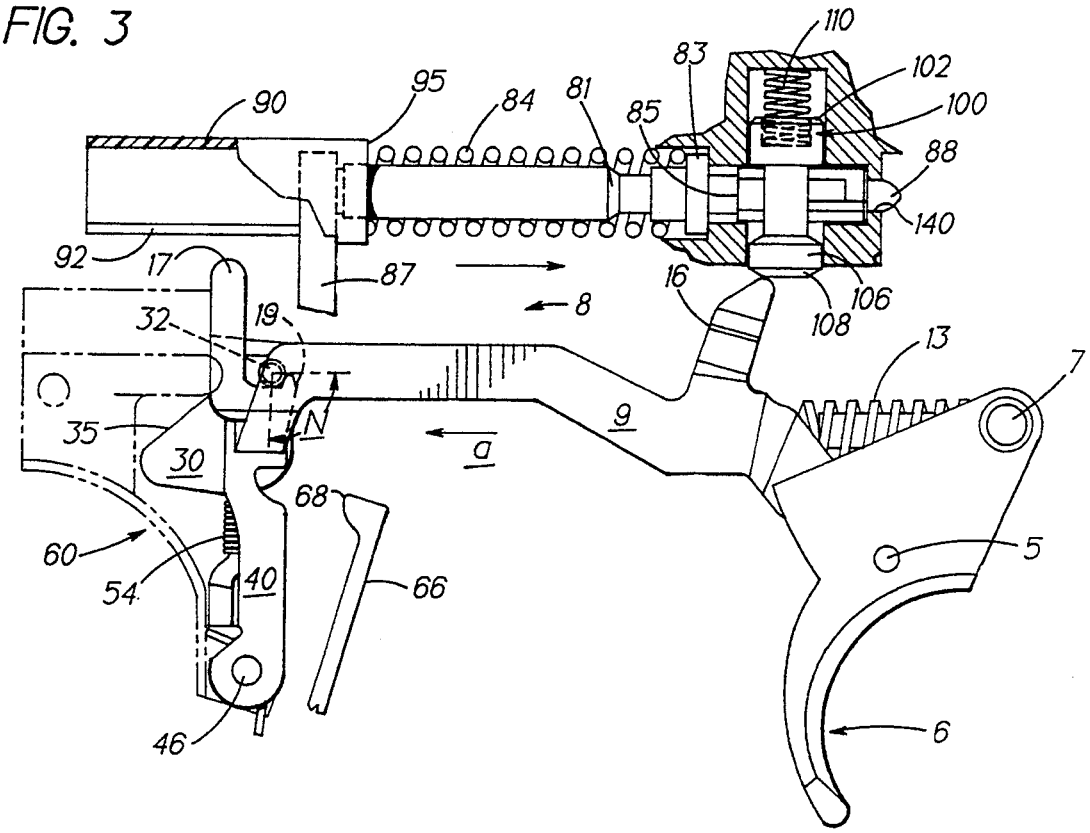
FIG. 3 is an elevational view of the firing mechanism of FIG. 2 shown after the firing pin has been released for firing.

The pivot arm 40 and the sear 30 together form a third class lever having its fulcrum or pivot point at pin 46. The input force is applied by the trigger bar 9 at pin 32 and the output, in the form of work, is the angular motion at control edge 37 of the sear 30 in response to rearward movement of the trigger bar 9, from a forward position, as shown in FIG. 1 to a rear position, as shown in FIG. 3. The control edge 37 of the sear is adapted to engage the leg 87 that extends from the firing pin 82 so that as it is moved rearwardly, the sear will cause the firing pin spring 84 to be compressed. The point at which the sear will release the firing pin is achieved when the sear 30 is moved downwardly by fixed cam 65 engaging the cam surface 35. The spring 54 is thereby compressed until the control edge has been lowered by translatory motion sufficiently to release the firing pin.

Figure 13:
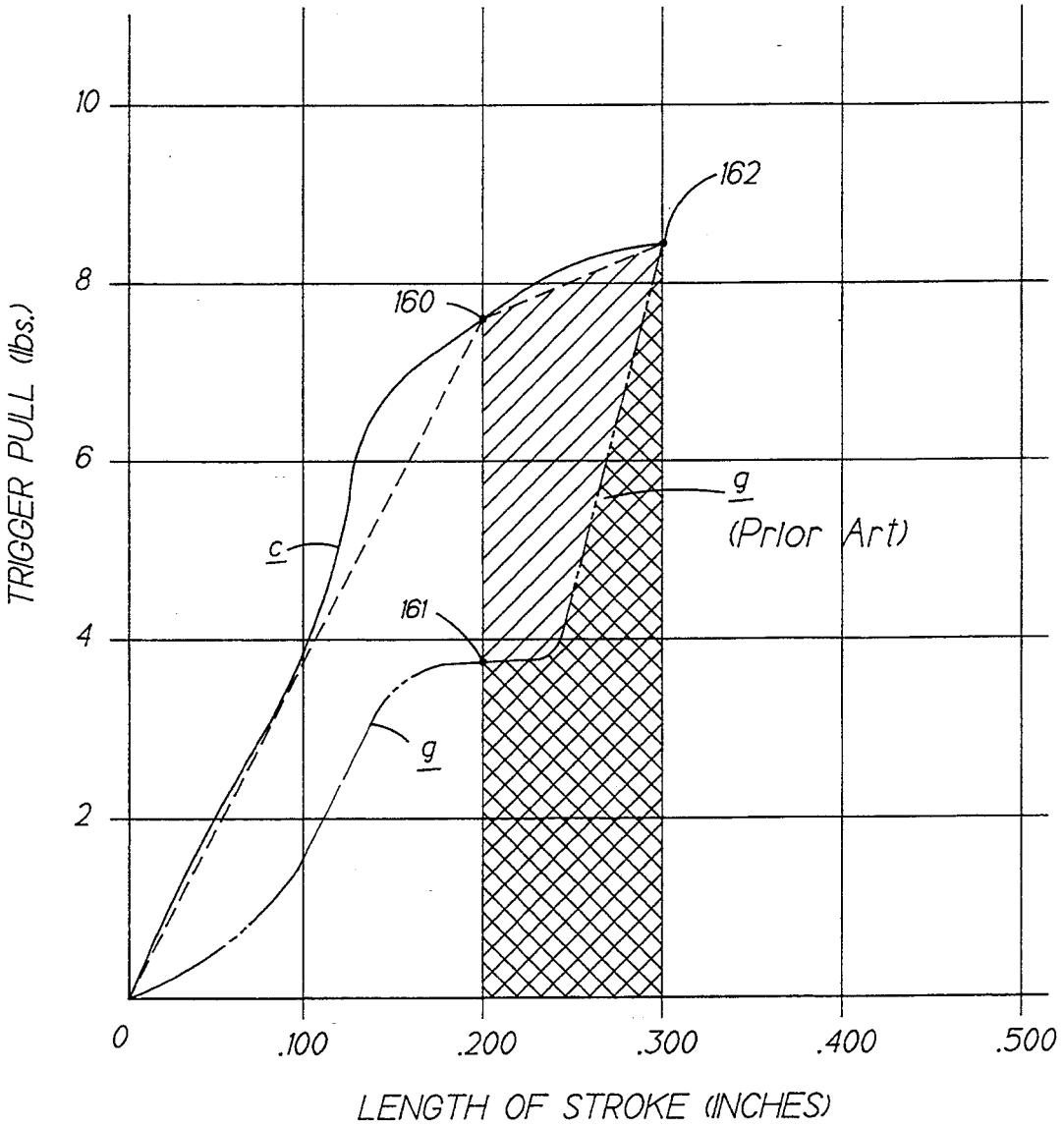
FIG. 13 is a graph of the trigger force versus the length of the trigger stroke from its initial or rest position until firing point of a firing mechanism embodying this invention in comparison with a mechanism of the prior art.

The pivot arm 40, when in its forward position as shown in FIG. 1, is disposed at an oblique angle o relative to the trigger bar 9 and in its rearward position, is disposed at an approximately perpendicular angle n to the trigger bar 9 as shown in FIG. 3. This configuration provides a significant decrease in the rate of increase of force required to pull the trigger during the terminal portion of the trigger stroke as illustrated in FIG. 13 which results in a "generally flat portion" at the terminal portion of the trigger stroke curve c between points 160 and 162, as will hereinafter be discussed in greater detail.

Figure 14:
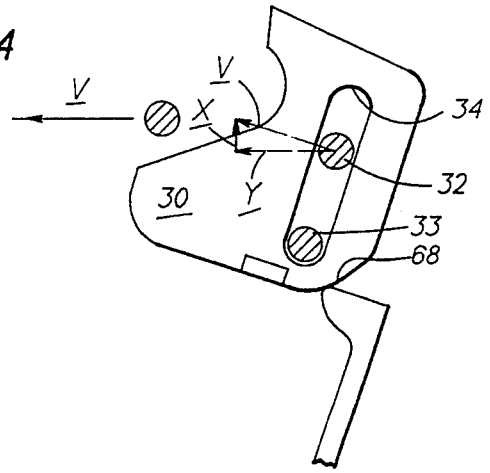
FIG. 14 is a schematic force vector analysis which illustrates motion of the sear in response to trigger pull.

During the movement of the trigger, for each increment of movement of the trigger bar 9, the pivot pin 32 and sear 30, angular motion will be imparted to the sear which will move in direction that can be represented by a vector v (FIG. 14) that is perpendicular to the longitudinal axis of the swing arm 40 and is composed of an essentially uniform horizontal component y and a vertical component x. The vertical component x will decrease as the pivot arm moves from its forward, oblique position toward its rearward, vertical position. It will be recognized that only the horizontal components of that motion which are parallel to the axis of the firing pin 82 and will cause the firing pin spring 84 to be compressed. As the swing arm 40 and sear 30 carried thereby approach the vertical position, generally perpendicular to the trigger bar 9, as shown in FIG. 3, the motion of the outer end of the sear will be essentially equal to the horizontal component since in that orientation of the arm 40, the vertical component would be zero. Since the amount of work to move the trigger over a given distance is directly related to the amount of movement of the pivot arm, the nullification of vertical component means that less force per unit length of trigger stroke will be required during the terminal portion of the stroke than in the initial portion thereof. Accordingly, the above-described geometric configuration serves to reduce the rate of increase of trigger pull during the terminal portion of the stroke, as shown in FIG. 13, and provides a firing mechanism which mimics the revolver.

As also shown in FIGS. 1 and 4, the firing pin striker 82 is disposed within a bore 121 located in the after-end portion of the slide 4. The pin 82 is movable longitudinally relative to the slide within the bore 121 that is open at its after-end to receive therein the firing pin 82 and sleeve 90. The inner wall of the bore 121 has a centrally located opening 125 adapted to receive therethrough a striker tip 88 of the pin 82. The firing pin comprises a unitary steel pin or rod 82 of cylindrical cross-section and is preferably coated with a nickel phosphorous alloy with Teflon® particles uniformly dispersed therein for properties of inherent lubricity and a low coefficient of friction. The firing pin 82 includes a roedial portion 81 of reduced diameter which forms a shoulder 85 at its forward end. A collar 83 is fitted onto the pin 82 and movable axially along the roedial portion 81 thereof.

It has been found that a coil spring 84 having a free length of 1.58 inches, a spring rate of 6.4 and when compressed by pivotable movement of the sear 30 to a length of 0.7 inch and then released, it will impart sufficient velocity and kinetic energy to the firing pin to fire a chambered round. The spring 84 is disposed about the firing pin and has its forward end seated against the rear surface of the flange portion of collar 83 and its rear end seated against the front wall 95 of the polymeric sleeve 90 fitted over the rear end portion of the firing pin 82 and disposed within the after-end of the bore 121. The sleeve includes a longitudinally extending and downwardly open cutout or slot 92 which extends along the lower edge of the sleeve 90 from a shoulder 93 at the forward or inner end of the cutout which is open at its rearward outer end. The radially extending leg 87 depends downwardly through slot 92 for engagement with the rear edge 37 of the sear. The widths, or transverse dimensions, of the leg 87 and control edge 37 are preferably approximately the same to minimize fretting or scoring thereof by one part of the other. The vertical extent of the engagement or overlap of the two parts is sufficient to enable the sear to move the firing pin rearwardly to its fully cocked position before the sear is lowered so that its sear surface 37 disengages the leg 87. The compressed spring 84 will then be released to impel the firing pin forward to strike and fire the round in the chamber of the gun barrel.

Adjacent its forward end, the firing pin 82 also includes a cutout 89 which defines a surface with a rear edge or shoulder 93, as is best illustrated in FIG. 6, adapted to engage a portion of head 102 of a safety mechanism 100. The area of engagement between the shoulder 93 and lower outer edge portion of the head 102 is sufficient to ensure that the firing pin will not be able to move past the safety to fire a chambered round except where the trigger has been intentionally actuated as when one intends. to fire the gun. The safety 100 is located within a bore 130 disposed transversely to the bore 121 and the longitudinal axis of the firing pin 82. The safety comprises a generally dumbbell shaped member, or plunger having head portions 102 and 106 and a central shank portion 104 of substantially smaller diameter than the head portions. The outer lower edge portion of the head 106 is chamfered as at 108 for smooth interengagement with a similarly chamfered edge as at 116 of finger 16 extending upwardly from the trigger bar 9.

A small coil spring 110 (FIG. 6) which, for ease of assembly, may be snapfitted and retained in a recess 128 provided in the upper surface of the head 102 serves to urge the plunger downwardly. The transverse bore 130 may be of generally the same cross-sectional configuration as the plunger itself, but is sized to accommodate vertical movement of the plunger over a stroke length to enable reciprocal movement of the plunger from its "lower" or "safe" position, shown in FIGS. 4 and 6, to its "upper" or "fire" position, shown in FIG. 2. In the "fire" position, the finger, or spur 16 of the trigger bar will have moved the plunger 100 upwardly, compressing spring 110 so that the head portion 102 of the plunger will clear the shoulder 93 (FIG. 6) of the firing pin 82 to enable the firing pin to be driven forwardly by the coil spring 84 when released by the sear 30.

After the first round has been chambered by manually cycling the slide 4 from its forward to its rearward position and which is returned to its forward position by recoil spring 144, the fire control mechanism will be in its ready to fire position, as shown in FIG. 1. In this position, it will be noted that the spur 16 of the trigger bar 9 will be forward of and out of operative engagement with the head 106 of the safety 100 and the hook 18 of the trigger bar 9 will be disposed in operative engagement with the laterally protruding portion of sear pin 32 (FIG. 8). The pivot arm 40 will be in its forward position, as in FIG. 1 and the sear 30 will be biased to its "up" position by coil spring 54. The control edge 37 of the sear will be fully engaged with the forward lower surface portion of the leg 87 of the firing pin 82. Although in this condition, firing pin spring 84 may be slightly tensioned, the mechanism is in a "safe" condition because of the of the safety 100 and cannot be fired unless the trigger is moved rearward to cause the firing pin to be cocked and released by the sear 30.

Figure 2:
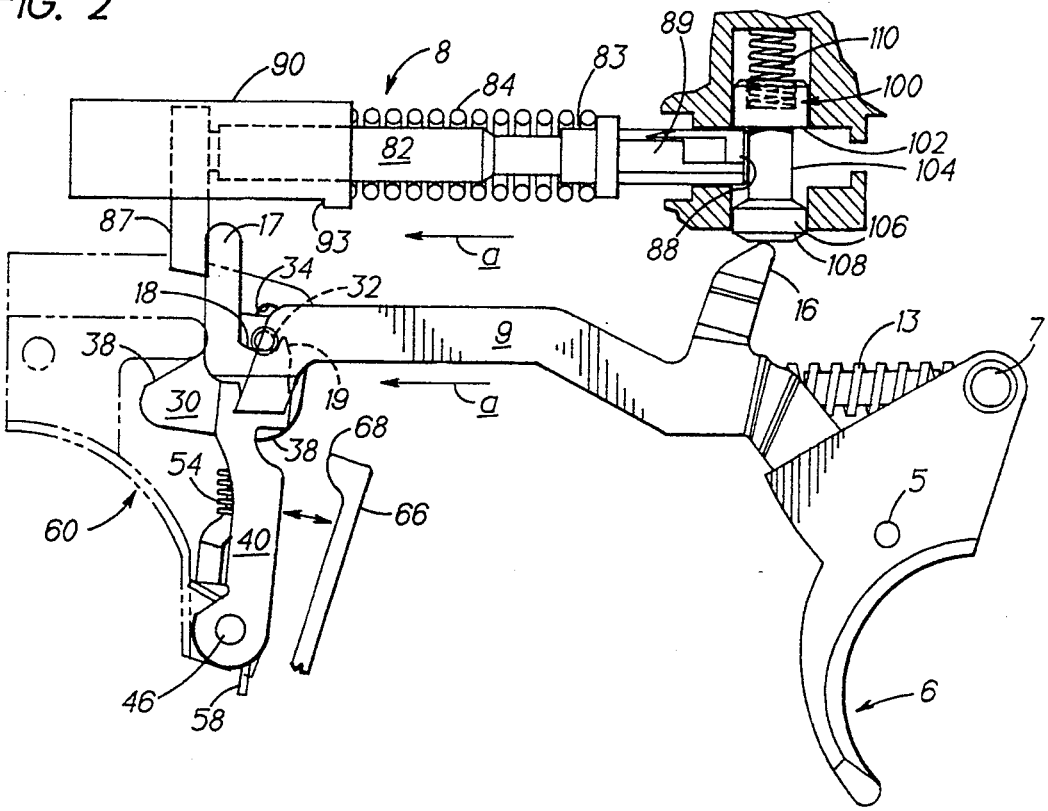
FIG. 2 is an elevational view of the firing mechanism of the handgun of FIG. 1 shown on an enlarged scale with the trigger being actuated and the firing pin being retracted and cocked in the firing sequence.

Referring now to FIG. 2, the trigger 6, a second class lever is actuated by pulling or squeezing the same to rotate the trigger rearwardly about pivot pin 7. As the spur 16 engages the head 106 of the safety 100, the safety will be moved so that the path of the firing pin 82 will be cleared for firing the round in the chamber. Rearward pivotable movement of trigger 6 will in turn move the trigger bar 9 rearward, as indicated by arrow a. The trigger spring 13 will be expanded or tensioned as the trigger 6 is moved rearward, torsion spring 58 will also be tensioned and coil spring 84 will be compressed.

In the preferred embodiment of this invention, the trigger stroke as illustrated in the graph of FIG. 13, has a length of approximately 0.300 inch and a trigger pull of approximately 8.5 pounds at the point of firing the gun, as represented at 162 at the upper end of the curve c. The curve graphically illustrates movement of the trigger from its starting position, corresponding to the origin, or zero point, of the graph to its firing point 162 and represents the force required to operate the firing mechanism of this invention by moving the trigger at each point over the stroke length of the trigger. The trigger pull in pounds is disposed along the ordinate of the graph and the stroke length in inches along the abscissa. As the trigger is being moved to fire the gun, the force applied to move the trigger will for example, as indicated by the slope of the curve c, have increased to approximately 7.5 pounds when the trigger has moved about 0.200 inch. This point in the stroke, represented at 160 on the curve c, is approximately two-thirds of the full stroke length. It will be noted that the slope of the trigger curve from the origin to point 160 illustrates a generally uniform and rapid rate of increase in the application of the force from zero to 7.5 pounds. From this point, the force required to move the firing mechanism to its firing point over the terminal end portion of the trigger stroke need be increased by only one pound. As illustrated in FIG. 13, the slope of the curve over the last 0.100 inch of the stroke, from 0.200 to 0.300 inch between points 160 and 162 on the graph, will be substantially less than during the first two-thirds of the trigger stroke. Thus, during the initial portion of the trigger stroke, up to approximately the 7.5 pound force level, the firing mechanism of this invention is characterized by a relatively high rate of increase in the level of force applied to the trigger. Thereafter, during the terminal portion of the stroke, from the point 160, the force necessary to fire the gun need only be increased by approximately one pound during the last 0.100 inches of the stroke. As illustrated by the cross-hatched area under the terminal portion of the curve in FIG. 13, the amount of work, or energy required to move the trigger over the terminal end portion of the trigger stroke is nonetheless relatively large and appears to be approximately in the same order of magnitude as the energy expended to move the trigger from its starting point 0 to point 160. As previously discussed, the geometric relationship of the trigger bar, pivotable sear and firing pin of this invention results in a curve of the trigger pull versus stroke length as herein discussed in connection with FIG. 13. This is an important consideration in selecting a gun for law enforcement since there is nothing more damaging to police morale and effective community relations than a situation in which a police officer has unintentionally fired his weapon and killed or wounded a suspect. In any such use, a police officer who has drawn and aimed a pistol at a criminal suspect, must have a high level of confidence that the pistol will not fire unless he is firmly committed and fully intends to do so. One of the principal objects of this invention, as previously stated, is to provide a firing mechanism which reduces the likelihood of such occurrences. Accordingly, as illustrated in FIG. 13, the officer must be quite aggressive or forceful in actuating the trigger during the full length of each trigger stroke, as is required in typical double action firing mechanisms. Also disclosed in FIG. 13, is a curve g for another presently available pistol plotted in from data obtained in the same manner as curve c and as will hereinafter be discussed in more detail. Continuing with the operation of the firing mechanism, as the trigger is being moved rearward, the hook 18 of the trigger bar 9 being engaged with the sear pin 32 will rotate the sear 30 and the pivot arm 40 counterclockwise, as shown in FIG. 2, to thereby cock the firing pin 82 and thus tension or load the sear spring 58. As the sear 30 is moved rearward, its control edge 37 engaged with the lower, forward edge of leg 87 of the firing pin 82 will carry the firing pin 82 rearwardly and thereby compress the firing pin spring 84. Also as illustrated in FIG. 2, with the sear 30 being rotated rearwardly, its cam follower surface 35 will engage the cam surface 65 of sear housing 60 which cams the sear 30 downward, thereby compressing coil spring 54. The control edge 37 of sear 30 will thereby also be moved downwardly until disengaged from the leg 87, as shown in FIG. 3. With that occurrence, the firing pin spring 84 will drive the firing pin 82 forwardly with sufficient force so that its tip 88, as shown in FIG. 3, will fire a round disposed in the chamber 40 of the barrel 143. It will be recognized that with the gun disposed in its normal or customary firing orientation movement of the trigger 6, firing pin 82, leg 87 and sear 30 will be coplanar in a vertical plane p, as illustrated edgewise in FIG. 5 and defined by the axis of the firing pin and the plane of motion of the sear 30 and the trigger 6.

After each round is fired, the slide 14 will be moved rearward under the recoil force generated by expanding combustion gases, or "blow-back". A cam surface or projection 96 disposed on the underside surface 97 of the slide 14, as shown in FIGS. 1 and 4, will engage and displace downwardly the upwardly extending disconnect arm 17 of the trigger bar 9. That downward movement will take place in a plane parallel to the plane of movement p of the sear 30 and will serve to disengage the hook 18 of the trigger bar 9 from the sear pin 32, allowing its pivot arm 40 and the sear 30 carried thereby to rotate toward its forward position under the force of the expanding sear spring 58. Such forward motion will cause the cam follower surface 35 to be disengaged from the cam surface 65 to allow the sear 30 to be moved along the plane of movement p upwardly by coil spring 54 as well as forwardly by spring 58 whereby the pivot arm 40 and sear 30 will be returned to their initial, ready positions, as shown in FIG. 1, with the sear 30 ready to be reengaged by the leg 87 for the next cycle of operation.

The blow-back of the slide 14 relative to the frame 12 will compress recoil spring 144 (FIG. 1) and in a conventional manner, its subsequent expansion will move the slide 14 toward its initial or forward position, as shown in FIG. 1. Since the firing pin spring 84 will perforce have fully expanded in firing the previous round, as shown in FIG. 3, the slide 14, as it is returned to its forward position by the recoil spring, will cause the depending leg 87 of the firing pin 82 to reengage the edge 37 of the sear (already in its forward "ready" position) and thus the firing pin 82 will be redisposed to its "ready" position, as depicted in FIG. 1.

Since the pistol embodying this invention has a semi-automatic action, the trigger 6 will be allowed to be moved forwardly when released or with relaxed finger pressure to ready the firing mechanism to fire the next round. The trigger spring 13 will return the trigger 6 and the interlinked trigger bar 9 to their fully forward positions, as shown in FIG. 1. At the same time, the upper edge of the disconnect arm 17 which is biased upwardly by the upward component of force acting on the trigger bar by the trigger spring 13 will be moved along the undersurface 97 of the slide until a cam surface 119 disposed on the leading edge of the lip 19 of the trigger bar 9 is engaged by the sear pin 32 to displace the trigger bar 9 downwardly until the pin 32 and the hook 18 are disposed in registered relation with one another. The trigger bar 9 will then be pivoted upwardly by the upward component of force f (FIG. 4) of the trigger spring 13 to reengage the pin 32 and hook 18 (FIG. 5).

In addition, as the trigger bar 9 is moved forwardly, its spur 16 will be carried forward of the head 106 of the safety plunger 100 to release the same so that the spring 110 will reposition the head 102 downward and into the path of the firing pin 82 to prevent accidental discharge of the gun. Accordingly, the firing pin 82 will be prevented from moving forwardly to strike a cartridge in the chamber unless the trigger is actuated.

Among the advantages of the firing mechanism of this invention over the prior art is that since all of the moving parts move in parallel planes, fewer and longer wearing parts are utilized which result in a longer life and greater reliability. The absence of any transverse movement serves to keep the operative parts in proper alignment with less tendency for distortion and/or misalignment over time. Furthermore, the absence of any transverse forces acting on the slide serves to ensure the smooth movement of the slide during recoil and which results in lower incidence of the slide jamming during counter-recoil.

Unlike in comparable pistols of the prior art, the firing mechanism of the present invention is such that the trigger pull to fire the gun requires that substantial and sustained force be applied throughout the entire stroke as discussed above in connection with FIG. 13. It is postulated that this feature, despite its heavier trigger pull, provides a double-action handgun that will have significantly fewer incidents of unintentional or accidental firings than comparable firing pin striker mechanisms of the prior art. This comparison is graphically illustrated in FIG. 13 in which curve c of this invention and curve g of a prior art pistol are plotted side-by-side for ease of comparison. The pistol of curve g includes a spring provided to assist in compressing or tensioning the firing pin spring by actuation of the trigger. In comparison to the curve c of this invention, the curve g of the prior art has a generally flatter slope throughout the first portion of the stroke to point 161 thus indicative of a substantially lower rate of increase in force per unit length of trigger stroke, believed to be the result of the spring which aids the trigger pull. This means that comparatively little force is required to move the trigger until point 161 is reached, but after which the slope of the curve g increases sharply indicating a much higher rate of increase in trigger pull during the latter or terminal portion thereof. Upon reaching a trigger pull of approximately 8 to 8.5 pounds, the gun will be fired, as at point 162. Although both guns will fire at approximately the same trigger pull and stroke length, it is believed that curve c is preferable to curve g because it represents more uniform expenditure of energy throughout the trigger stroke. While the prior art gun of curve g represents a relatively light trigger pull, that may be preferred by some shooters, it is believed to represent the expenditure of insufficient energy in the earlier portion of the stroke. In its terminal portion, the curve g rises abruptly in a "spike" indicating a trigger pull rate per unit length of trigger pull of approximately 4 pounds per 0.100 inch of trigger stroke and it will be most difficult to "feel" or sense when the gun is about to fire because of the steepness of that slope from point 161 to point 162 of the curve g, except for the short generally horizontal section immediately after point 161. In addition, the amount of work or energy to move the trigger from point 160 to 162 is substantially less than for the gun embodying our invention as will be apparent by comparing the areas under the respective portions of the two curves.

Such currently available pistols can be fired with such a short trigger pull and brief exertion of force on the trigger that it can be fired almost before the shooter is fully expecting it to fire, as with a fully automatic gun. In contrast, the firing mechanism of this invention has a trigger pull which is of the same length from the first to last round to be fired, as is typical of double action pistols, and requires a deliberate and sustained effort throughout the stroke including the terminal portion thereof.

The combination of the features described above result in a firing mechanism for a semiautomatic pistol that mimics the "double-action" of the revolver, for very many years the standard weapon of police departments throughout the United States. It is believed that those police officers trained in the use of the revolver, guns embodying this invention fire more similar to a revolver than other semiautomatic pistols because in this gun, the trigger stroke is uniform in length and the pressure required to actuate the trigger generally increases as does the service revolver. Indeed, it is expected that such law enforcement personnel will require little or no retraining to become fully familiar with the operation of the firing mechanism of this invention.

In addition, in accordance with this invention, virtually all of the forward momentum or kinetic energy of the slide 14 generated by the return or recoil spring during recycling thereof is utilized to pick up the next round from the magazine, ram it into the chamber and close the breech. Accordingly, superior recycling of the slide back to its fully closed or "ready position" is the inherent result. Moreover, operation of the firing mechanisms embodying this invention is such that the interengaging parts thereof will have maximum wear life due in part because of the reduced incidence of forceful impact between those portions of the firing pin and the sear which cooperate in the full compression and release of the firing pin spring.

Another advantage of this invention is provided by radiused surfaces 38 of the metal sear and the plastic surface 68 of the sear block 60 which, as discussed above, and as shown in FIGS. 11 and 12, function to ensure that the sear 30 will be returned to its "up" position in the event of failure of coil spring 54. In connection with this arrangement, it will be recognized by those skilled in the art that there is only a line of contact between these two oppositely curved surfaces and because one is a polymer and the other is a coated metal, as described above, the contacting surfaces are characterized by a very low coefficient of friction of 0.10 to 0.12. Once one begins to squeeze the trigger 6 and the sear 30 has begun to be moved rearwardly, the surfaces 38 and 68 will separate immediately without any further contact and drag caused by continuing engagement of the two parts. It should therefore be recognized that when the spring 54 is functioning properly, the radiused surfaces do not perform any function except in the event that the user has begun to squeeze the trigger and then before firing, decides not to fire and releases the trigger. The partial rearward movement of the trigger would have caused the sear 30 to be cammed partially downward by surfaces 35 and 65. Upon release of the trigger, the friction between surface 37 of the sear and the leg 87 of the firing pin 82 (see FIG. 1 ) may overcome the force of the sear spring 54 and prevent it from lifting the sear 30 to its "up" position. In such a situation, the radiused surfaces will then assist in the return of the sear 30 to its upper position in the same manner as if the spring 54 were broken.

A further advantage of this invention over the prior art is that as shown in FIG. 6, the safety mechanism provides a greater area of interference, or engagement between shoulder 93 and head 102 than in the prior art. This increase in the interference area is believed to provide superior performance of this gun from the standpoint of operational safety.

The foregoing description is intended primarily for purposes of illustration. Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described my invention, what is claimed is:

1. A fire control mechanism for a striker operated double action, semiautomatic handgun including a frame, a barrel mounted on the frame having a chamber at its breech end, a slide reciprocably mounted on the frame and including a breech block and a firing pin and having a forward position in which the breech block closes the breech chamber end of the barrel, a recoil spring for returning the slide to its forward position, the firing pin being movable longitudinally relative to the slide, a trigger and a trigger bar also movable longitudinally in response to movement of the trigger which has a rearward stroke from an initial position to a terminal position, the improvement comprising a sear pivotably disposed on the frame between forward and rearward positions and including at least one cam surface for displacing the sear downwardly of the firing pin, said sear being movable generally in a plane of motion and including an edge portion for controlling the operation of the firing pin by cocking and then releasing said firing pin in response to angular and translatory movement of the sear to a predetermined point of release of said firing pin, a spring yieldably urging the sear toward its forward position, said firing pin including an extension adapted to be disposed in said plane of movement of the controlling edge portion of the sear for engagement and disengagement therewith at said point of release of said firing pin by the sear, said point of release corresponding to said terminal position of the trigger in response to actuation of the trigger, said trigger bar including a disconnector portion disposed for moving the trigger bar downwardly in coplanar relation with the plane of motion of said edge portion of the sear in response to recoil of the slide whereby said sear will be released by the trigger bar for return by said spring to its forward position with said extension of the firing pin in said initial position.

2. A fire control mechanism of claim 1, in which said one cam surface is disposed on another edge portion of the sear and is adapted to engage a first cam actuating member of polymeric material that is stationary with respect to said one cam surface and said sear comprising a metallic material.

3. A fire control mechanism of claim 2, in which said sear is carried by a pivotable arm and is radially movable along said arm and a compression coil spring is provided on said arm for yieldably urging the sear from and to a lower and upper position with respect to the firing pin, said arm being disposed within a polymeric housing in the frame, a rear wall portion of the housing defining said first cam actuating member.

4. A fire control mechanism of claim 3, in which said housing includes said rear wall portion and a front wall portion with a portion of the latter defining a second cam actuating member and said sear including a second cam surface engageable with said second cam actuating member and being disposed on the forward surface of the sear for returning the sear to its upper position, should the compression coil spring fail to do so.

5. A fire control mechanism of claim 4, in which said sear includes an abhesive material and said housing also includes an abhesive material so that engagement between cam surfaces and cam actuating members is characterized by a coefficient of friction which provides for easy sliding contact therebetween.

6. A fire control mechanism of claim 5, in which said sear comprises a plate of generally polygonal configuration including lower, upper, forward and rear edge portions, an elongated slot having its longer axis disposed generally parallel to the forward edge portion thereof, said rear surface extending at an acute angle relative to the axis of said slot and defining said one cam surface and said control edge portion of said sear being disposed to engage said firing pin extension in surface-to-surface engagement, said extension including an abhesive material to provide, in areas of surface engagement between said firing pin extension and said controlling edge portion, a coefficient of friction which provides for easy and wear resistant sliding contact therebetween.

7. A fire control mechanism of claim 1, in which the sear is carried by a swing arm pivotable about a pin in response to actuation of the trigger and of the trigger bar linked thereto, the sear and swing arm being disposed at an oblique angle to the trigger bar during an initial portion of the trigger stroke, that is as the trigger is moved from said initial position, and in a terminal portion of the stroke, that is as the trigger approaches said terminal position, the sear is movable to a position generally normal to the trigger bar at approximately said point of release of the firing pin by said sear whereby said trigger stroke is characterized by a rate of change of pull per unit length to actuate said trigger being substantially less over said terminal portion of the stroke than in said initial portion thereof.

8. A fire control mechanism of claim 7, in which the trigger stroke is further characterized by the pull required to actuate said trigger being of substantially decreasing rate of change as the trigger approaches said terminal position.

9. A fire control mechanism of claim 1, in which a trigger spring urges the trigger toward its initial position and comprises an extension type coil spring and includes a shock absorbing material disposed within the coils of the trigger spring.

10. A fire control mechanism of claim 9, in which said shock absorbing material comprises a felt material of cylindrical configuration.

11. A fire control mechanism of claim 1, in which said trigger and said trigger bar are linked together and are releasably urged toward said initial position by an extension type coil spring, the spring that urges the sear toward its forward position comprises a torsion spring and a third spring urging the sear from a lower to an upper position relative to the firing pin and comprises a compression coil spring, said springs being tensioned by actuation of the trigger from its initial position toward its terminal position.

* * * * *